United States Patent [19]

Brunjes

[11] Patent Number: 5,002,311

[45] Date of Patent: Mar. 26, 1991

[54] PARCEL WAYBILL

[75] Inventor: Gerald A. Brunjes, Ontario, Canada

[73] Assignee: Moore Business Forms, Grand Island, N.Y.

[21] Appl. No.: 464,240

[22] Filed: Jan. 12, 1990

[30] Foreign Application Priority Data

Sep. 29, 1989 [CA] Canada ..... 615023

[51] Int. Cl.[5] ..... B41L 1/20

[52] U.S. Cl. ..... 282/9 R; 282/8 R; 229/74; 283/79

[58] Field of Search ..... 282/8 R, 9 R, 22 R; 229/68, 69, 70, 74; 156/253, 268; 206/47 R, 610; 283/79

[56] References Cited

U.S. PATENT DOCUMENTS

| | | | |
|---|---|---|---|
| 1,497,702 | 6/1924 | Stanley | 229/74 |
| 3,199,769 | 10/1965 | Hillman II, et al. | 229/74 |
| 3,525,470 | 8/1970 | Carrigan | 229/74 |
| 3,580,489 | 5/1971 | Oettinger | 229/70 |
| 3,695,422 | 10/1972 | Tripodi | 206/47 R |
| 3,974,311 | 8/1976 | Cherrin | 428/43 |
| 3,987,960 | 10/1976 | Gardiner | 229/74 |
| 4,000,916 | 1/1977 | Lucas | 282/11.5 A |
| 4,103,821 | 8/1978 | Gartshore et al. | 229/74 |
| 4,153,163 | 5/1979 | Alderman et al. | 206/610 |
| 4,323,608 | 4/1982 | Denny et al. | 428/43 |
| 4,368,903 | 1/1983 | Jones | 229/74 |
| 4,407,524 | 10/1983 | Trautlein | 282/9 R |
| 4,592,572 | 6/1986 | Instance | 281/2 |
| 4,598,935 | 7/1986 | Stewart | 283/81 |
| 4,667,984 | 5/1987 | Nitta | 282/8 R |
| 4,688,826 | 8/1987 | Hosoya | 283/79 |
| 4,711,686 | 12/1987 | Instance | 156/227 |
| 4,798,401 | 1/1989 | Greig | 282/9 R |

FOREIGN PATENT DOCUMENTS

| | | |
|---|---|---|
| 1116137 | 1/1982 | Canada . |
| 0216546 | 7/1988 | European Pat. Off. . |
| 2337625 | 1/1976 | France . |

*Primary Examiner*—Frank T. Yost
*Assistant Examiner*—Hwei-Siu Payer
*Attorney, Agent, or Firm*—Nixon & Vanderhye

[57] ABSTRACT

A parcel waybill is provided, having a clear plastic cover sheet and a document package. The inside face of the cover sheet is coated with an adhesive and the uppermost sheet of the document package and at least one insert sheet of the document package are comprised of carbonless copy paper adapted to provide a visible image thereon. The cover sheet is adapted to form, in conjunction with a surface of a parcel, an envelope pocket removably holding the document package.

5 Claims, 2 Drawing Sheets

PARCEL WAYBILL

BACKGROUND AND SUMMARY OF THE INVENTION

This invention relates to a parcel waybill, having a clear waterproof cover sheet and a document package comprised of multiple insert sheets, of the type that is typically affixed to the outside of a parcel.

Waybills of this type are generally provided with a cover sheet at least partly coated with an adhesive, and a document package comprised of pressure sensitive transfer layers interposed between various insert sheets. This arrangement provides the user with multiple copies of material that the shipper has inscribed on the top surface of the waybill. The transfer layer may consist of either a layer of carbon paper positioned between the sheets or the use of insert sheets consisting of carbonless copy paper that incorporates micro encapsulated ink pellets on one of the surfaces of the sheet.

When a waybill of this type is affixed to the package, the waybill and package define an envelope enclosing the insert sheets. The clear cover sheet forms the front face of the envelope and the rear face of the envelope is defined by the face of the parcel itself. A release sheet that adheres to exposed adhesive-coated portions of the cover sheet may be provided on the back face of the waybill, and this release sheet is removed when the waybill is to be fastened to a parcel.

Waybills should meet several criteria, among them ease of manufacture and convenience of use. With respect to the former, the waybill should have a minimum of layers and adhesive coating applied to the layers should be applied evenly rather than in a pattern. With respect to the latter criteria, it is desirable to provide a waybill that may have a sheet that remains affixed to the waybill, that bears the information that the user has printed on the waybill. This should be accomplished with a minimum of inconvenience on the part of the user.

Previous attempts to provide the user with a permanent record affixed to the package have included the use of a weatherproof cover sheet on which it is possible to write, for example, as described in U.S. Pat. No. 4,667,984. This solution imposes a relatively high manufacturing expense. In U.S. Pat. No. 4,688,826 a waybill is disclosed wherein a cover sheet is fully coated with an adhesive and to which may adhere the uppermost layer of the documentation package. However, this device suffers the disadvantage that the user cannot inscribe his information on a waybill wherein the cover sheet and document package (and release sheet, if desired) have been assembled; the user of this arrangement must assemble the waybill following the inscription of the information.

It is the object of this invention to overcome the above mentioned disadvantages of conventional waybills.

More specifically, the present invention provides a fully assembled waybill with a plurality of layers assembled in order. Relevant information may be typed or handwritten on a cover sheet (or an outer fly sheet) of the assembly, and this information is transferred onto an exposed outer face of a first sheet by way of a carbonless copying layer thereon. The information is similarly transferred to one or more insert sheets. In this exemplary embodiment, the first sheet remains permanently affixed to an inner face of the cover sheet by means of an adhesive coating on the underside or inner face of the cover sheet. The fly sheet is intended to be removed and retained by the shipper.

Upon removing a release sheet provided as a bottom layer under the one or more insert sheets, the waybill may then be affixed to a package, with the side edges of the cover sheet that extend beyond the underlying document package adhered to the package. In this way, the cover sheet and associated portion of the package define an envelope that encloses the document package. The one or more insert sheets are removably retained within the envelope.

In a second embodiment of the invention, a film fly sheet is interposed between the cover sheet and the first sheet of the package, the film fly sheet being comprised of a clear plastic layer that adheres to the pressure sensitive layer of the cover sheet. In this second exemplary embodiment, the first sheet is visible through the cover sheet but is not adhered to the cover sheet and may be removed together with the insert sheets.

Accordingly, in one exemplary embodiment, the present invention relates to a parcel waybill comprising:

(a) a clear cover sheet having an inner and outer face and front, rear and side edges, the inner face being coated with an adhesive;

(b) a first sheet under the cover sheet, the first sheet comprised of carbonless copy, i.e., self-contained paper adapted to provide a visible image on the upper surface thereof in response to the pressure thereon, the first sheet having front, side and rear edges, the side edges being recessed from the corresponding edges of the cover sheet;

(c) insert sheets adapted to be inserted under the first sheet, at least one of which sheets comprising a self-contained paper sheet, the insert sheets having front, side and rear edges, the side and rear edges thereof being generally co-extensive with the first sheet; and (d) a release sheet positioned under the insert sheets and having front, side and rear edges generally co-extensive with the corresponding edges of the cover sheet.

Additional objects and advantages of the invention will become apparent from the detailed description which follows.

DETAILED DESCRIPTION OF THE DRAWINGS

Figure 1:
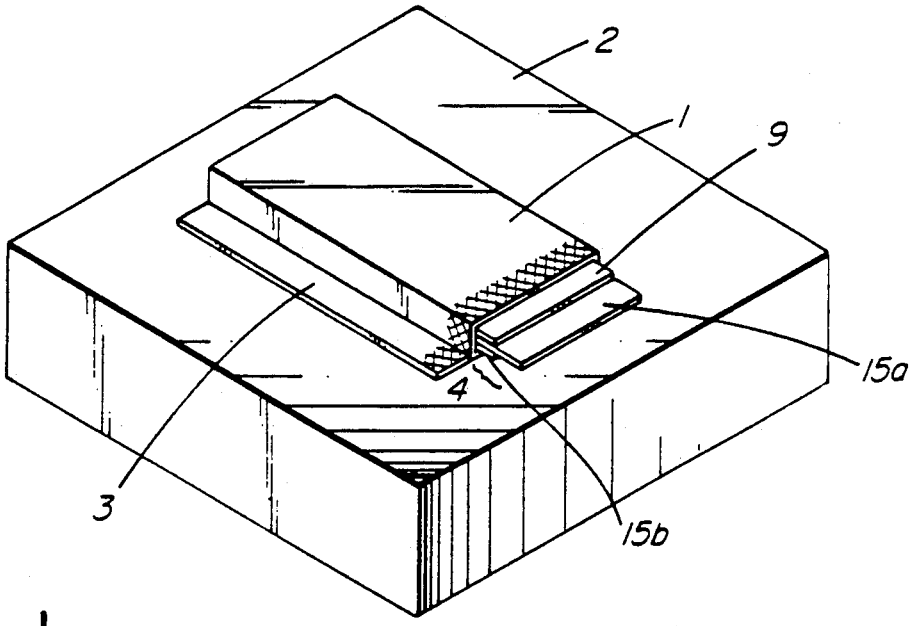
FIG. 1 is a schematic view, in perspective, of a waybill according to the present invention fastened to a parcel.

Referring to FIG. 1, a waybill 1 according to the present invention is illustrated, affixed to a flat surface of a parcel 2. The waybill 1 is provided with a clear plastic cover sheet 3 that has an adhesive backing, and a document package 4 comprised of multiple insert sheets 15(*a*) and (*b*) and first sheet 9. A fly sheet 5 referred to below has been removed.

Figure 2:
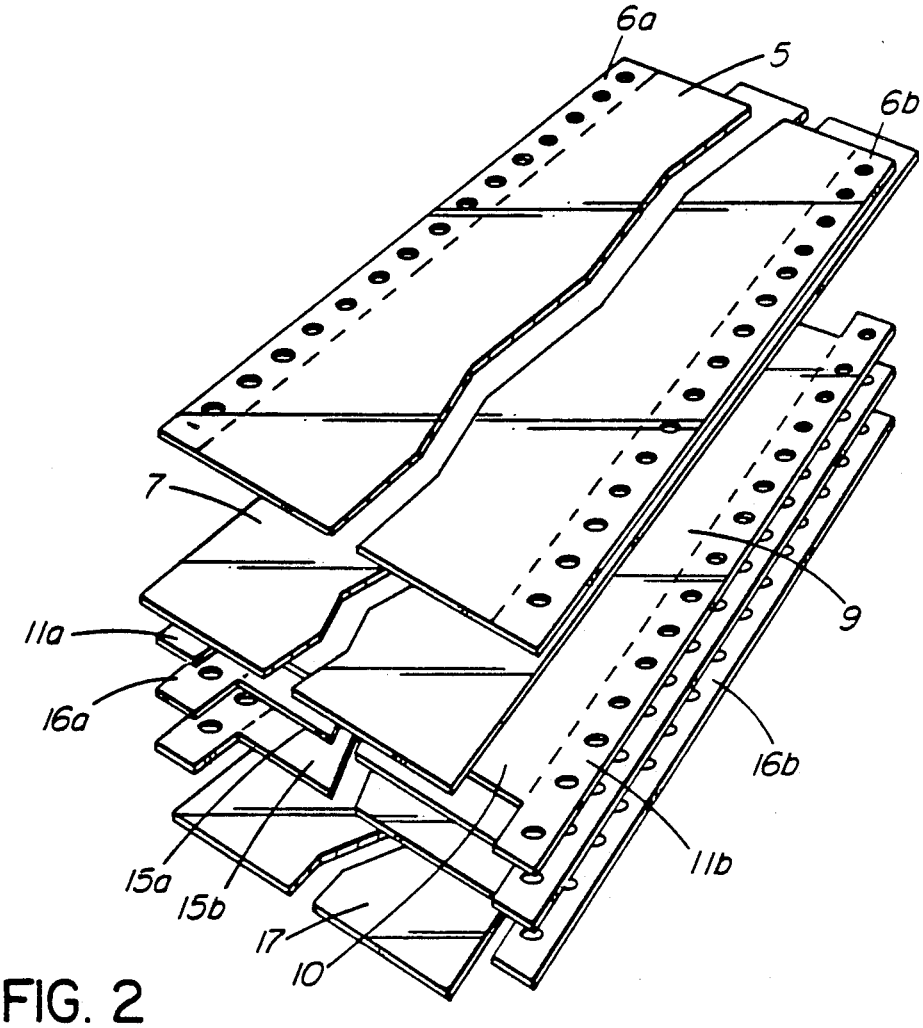
FIG. 2 is an exploded view of a first embodiment, in perspective.
Figure 3:
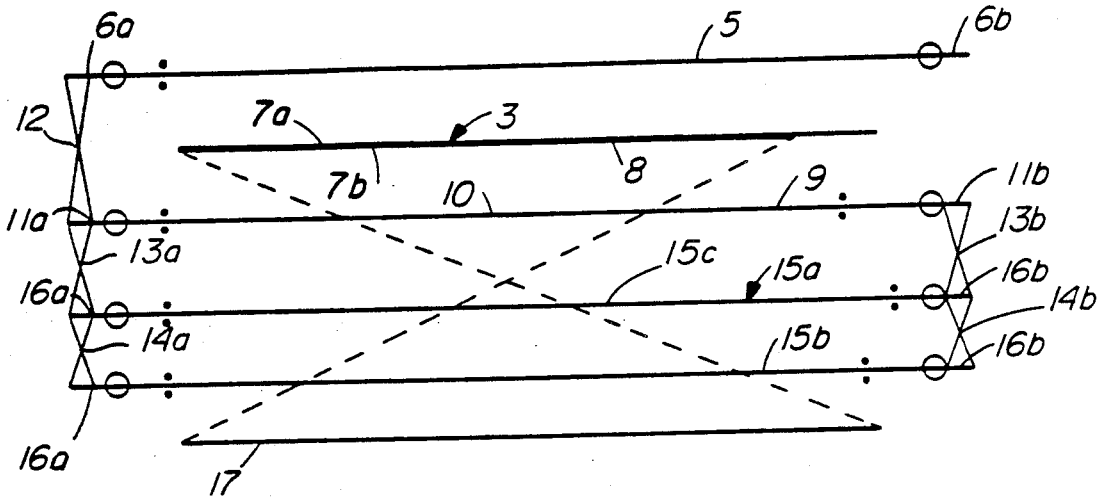
FIG. 3 is a schematic view of a cross section of the first embodiment.

Referring to FIGS. 2 and 3, the waybill 1 is illustrated prior to being affixed on the parcel. The waybill 1 is comprised of multiple layers, which from top to bottom are as follows:

(a) a paper fly sheet 5, having tear-off strips 6(*a*) and 6(*b*) along the front and rear edges thereof respectively;

(b) a clear plastic cover sheet 3 having an exposed outer face 7(*a*) and an inner face 7(*b*) that faces the document package, the entire inner face being coated with an adhesive layer 8;

(c) a first sheet 9 comprised of a carbonless copy sheet, having a carbonless copy, i.e., a self-contained layer 10 on the top surface thereof comprised of microencapsulated ink and associated resin composition (a mixture of conventional CB/CF coatings); and tear-off strips 11(*a*) and 11(*b*) along the front and rear edges thereof respectively; the paper fly sheet is adhesively secured to the sheet 9 along one edge thereof by an adhesive strip 12;

(d) multiple insert sheets 15(*a*) and (*b*), each having tear-off strips 16(*a*) and 16(*b*) along the front and rear edges thereof respectively; and at least one of which also is provided with a CB/CF coating 15(*c*) and (e) a release sheet 17 generally co-extensive with the cover sheet 3.

The tear-strips 11(*a*) and 11(*b*), 16(*a*) and 16(*b*) are coated with a pressure-sensitive adhesive 13(*a*), 13(*b*) and 14(*a*), 14(*b*), respectively, that adheres the first sheet 9 and the multiple sheets 15(*a*) and (*b*) together. The cover sheet 3 extends over a part of the rear tear-off strips 11(*b*) and 16(*b*), as best seen in FIG. 3, and affixes the document package to the cover sheet.

In use, a shipper is provided with a fully assembled waybill having all the layers thereof assembled in order. The relevant shipping information may then be typed or handwritten on the waybill, the writing being inscribed on the fly sheet 5, which is intended to be removed and retained by the shipper. If no fly sheet is provided, then the information is inscribed directly on the cover sheet 3. The inscribed writing is copied onto the exposed outer face of the first sheet 9, by way of the CB/CF layer 10 thereon. The writing is also similarly transferred through to the one or more of the self-contained insert sheets 15(*a*), 15(*b*). In this first embodiment, the first sheet 9 remains permanently affixed the inner face of the cover sheet 3 by the adhesive coating on the cover sheet.

The waybill may then be affixed to a package by removing the release sheet 17 and pressing the waybill onto a flat surface of the package. The side edges of the cover sheet 3 that extend beyond the underlying document package adhere to the package, and the cover sheet 3 and associated portion of the package define an envelope that encloses the document package. The rear set of tear-off strips 11(*b*), 16(*b*) remains adhered to the cover sheet, and this arrangement removably retains the insert sheets 15(*a*) and (*b*) within the envelope. The front tear-off strips 11(*a*), 16(*a*) may be removed at any time following assembly of the waybill.

Figure 4:
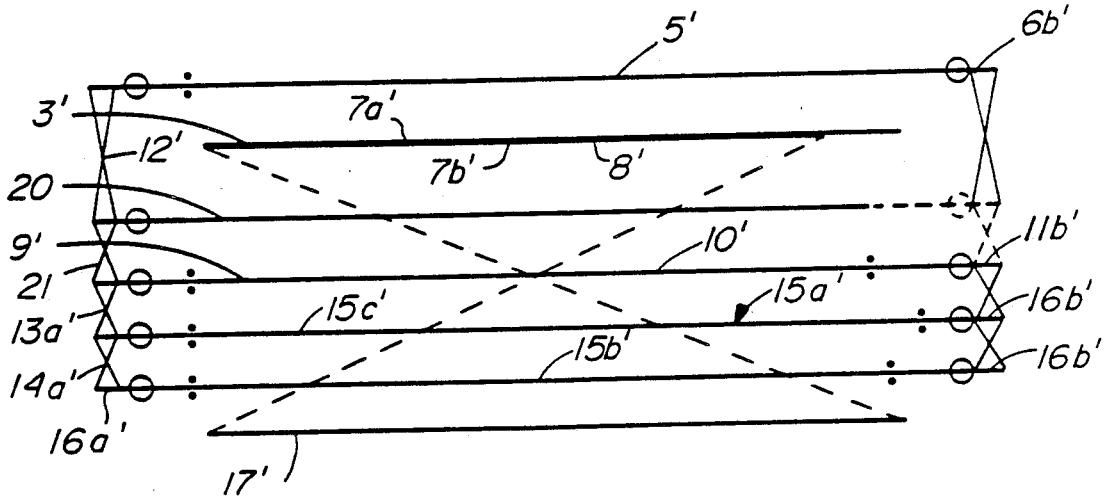
FIG. 4 is a similar schematic cross section of a second embodiment.

Referring to FIG. 4, a second embodiment of the invention is illustrated. This embodiment has a film fly sheet 20 interposed between the cover sheet 3' and the first sheet 9' and adhesively secured to sheet 5' by adhesive 12' and to sheet 9' by adhesive 21. The film fly sheet 20 is comprised of a clear plastic layer that adheres to the pressure sensitive layer of the cover sheet 3'. In this embodiment, the first sheet 9' is visible through the cover sheet, but it may be removed together with the insert sheets 15(*a*)'. The release sheet 17' is identical to that in the first embodiment.

It will be seen that the present invention allows the use of a cover sheet 3 or 3' that has been fully coated with an adhesive on the inner face 7(*b*) or 7(*b*)' thereof, thus simplifying manufacture of the waybill and allowing the use of a first sheet 9 or 9' permanently affixed to the inside face 7(*b*) (FIG. 3), or the film fly sheet 20 (FIG. 4) of the cover sheet. The first sheet 9 or 9' is provided with a CB/CF coating 10 or 10' that allows the user to print the desired information on the fully assembled waybill and be provided with a record of the information, visible on the first sheet.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A parcel waybill comprising:

(a) a clear cover sheet having an inner and outer face and front, rear and side edges, said inner face being coated with an adhesive;

(b) a first sheet under said cover sheet, said first sheet comprised of self-contained paper adapted to provide a visible image on the upper surface thereof in response to pressure exerted thereon through said cover sheet, said first sheet having front, side and rear edges, said side edges being recessed from the corresponding edges of said cover sheet;

(c) at least one insert sheet adapted to be inserted under said first sheet, said at least one insert sheet comprising a self-contained paper sheet having front, side and rear edges, the side and rear edges thereof being generally co-extensive with said first sheet;

(d) a release sheet positioned under said insert sheets and having front, side and rear edges generally co-extensive with the corresponding edges of said cover sheet.

2. A parcel waybill according to claim 1, wherein there is further provided a fly sheet above said cover sheet.

3. A parcel waybill according to claim 2, wherein said at least one insert sheet and said fly sheet are provided with tear-off strips on the front and rear edges thereof, said strips being coated with an adhesive and adapted to releasably engage each other.

4. A parcel waybill according to claim 1, wherein there is further provided a clear film fly sheet interposed between said cover sheet and said first sheet, said film fly sheet having side and rear edges generally co-extensive with said first sheet.

5. A parcel waybill comprising:

(a) a clear cover sheet having an inner and outer face and front, rear and side edges, said inner face being coated with an adhesive;

(b) a first sheet under said cover sheet, said first sheet comprised of self-container paper adapted to provide a visible image on the upper surface thereof in response to pressure exerted thereon through said cover sheet, said first sheet having front, side and rear edges, said side edges being recessed from the corresponding edges of said cover sheet;

(c) at least one insert sheet adapted to be inserted under said first sheet, said at least one insert sheet comprising a self-contained paper sheet having front, side and rear edges, the side and rear edges thereof being generally co-extensive with said first sheet;

(d) a release sheet positioned under said insert sheets and having front, said and rear edges, the side and rear edges thereof being generally co-extensive with said first sheet;

(e) a release sheet positioned under said insert sheets and having front, side and rear edges generally co-extensive with the corresponding edges of said cover sheet; and wherein, upon removal of said release sheet, the waybill may be adhered to a parcel by means of said adhesive on the side edges of the cover sheet which extend beyond the side edges of the first and said at least one insert sheet to thereby form an envelope in conjunction with a surface of the parcel, said envelope removably securing said at least one insert sheet.

* * * * *